United States Patent [19]

Fukumoto et al.

[11] Patent Number: 5,005,882

[45] Date of Patent: Apr. 9, 1991

[54] AUTOMOTIVE DOOR LOCK DEVICE

[75] Inventors: Ryoichi Fukumoto, Nagoya; Shigeru Hayakawa, Chiryu; Nozomu Torii, Hekinan, all of Japan

[73] Assignee: Aisin Seiki Kabushiki Kaisha, Kariya, Japan

[21] Appl. No.: 413,533

[22] Filed: Sep. 28, 1989

[30] Foreign Application Priority Data

Sep. 30, 1988 [JP] Japan ..... 63-244530

[51] Int. Cl.[5] ..... E05C 3/26

[52] U.S. Cl. ..... 292/216; 292/DIG. 56

[58] Field of Search ..... 292/280, 210, 216, 201, 292/DIG. 56

[56] References Cited

U.S. PATENT DOCUMENTS 4,358,141 11/1982 Hamada ..... 292/216

4,775,176 10/1988 Ikeda ..... 292/216

FOREIGN PATENT DOCUMENTS 55-49403 11/1980 Japan .

*Primary Examiner*—Richard E. Moore

*Attorney, Agent, or Firm*—Finnegan, Henderson, Farabow, Garrett and Dunner

[57] ABSTRACT

An automotive door lock device having a pawl mounted on a pawl pin. The pawl pin is mounted at one end to a base of the lock device and is supported intermediate the ends to a sub-base spaced from the base. The pawl pin has an integral flange disposed between the sub-base and the base. A collar is disposed surrounding the pawl pin between the base and the sub-base. The pawl pin is fixed on the sub-base by lift lever 12, collar 19, outer lever 15, and washer 20.

5 Claims, 7 Drawing Sheets

AUTOMOTIVE DOOR LOCK DEVICE

BACKGROUND OF THE INVENTION

1. Field of the Invention

The present invention relates to an automotive door lock device.

2. Description of the Prior Art

In a conventional automotive door lock device, a pawl-pin, on which a pawl is rotated to be engaged with a striker, is rotatable relative to and a sub-base as disclosed in Japanese Utility Model Publication No. 55-49403. For smooth rotation of the pawl-pin, a relatively large clearance is defied between the pawl-pin and the base.

However, due to the existence of this clearance, the pawl-pin is subject to play, thereby generating noise.

SUMMARY OF THE INVENTION

It is, therefore, a primary object of the present invention to provide an automotive door lock device without aforementioned drawback.

Another object of the present invention is to provide a door lock device in which a pawl-pin is secured to a sub-base.

To achieve the purpose of the present invention, an automotive door lock device is comprised of a pawl-pin on which a pawl is rotated, a collar mounted on the pawl-pin, and a flange formed on a the pawl-pin and is held between a stationary member and the collar.

DESCRIPTION OF THE PREFERRED EMBODIMENTS

A body of an automotive door lock is connected to the actuator 2 which is used for unlocking with an electric switch plate.

Figure 2:
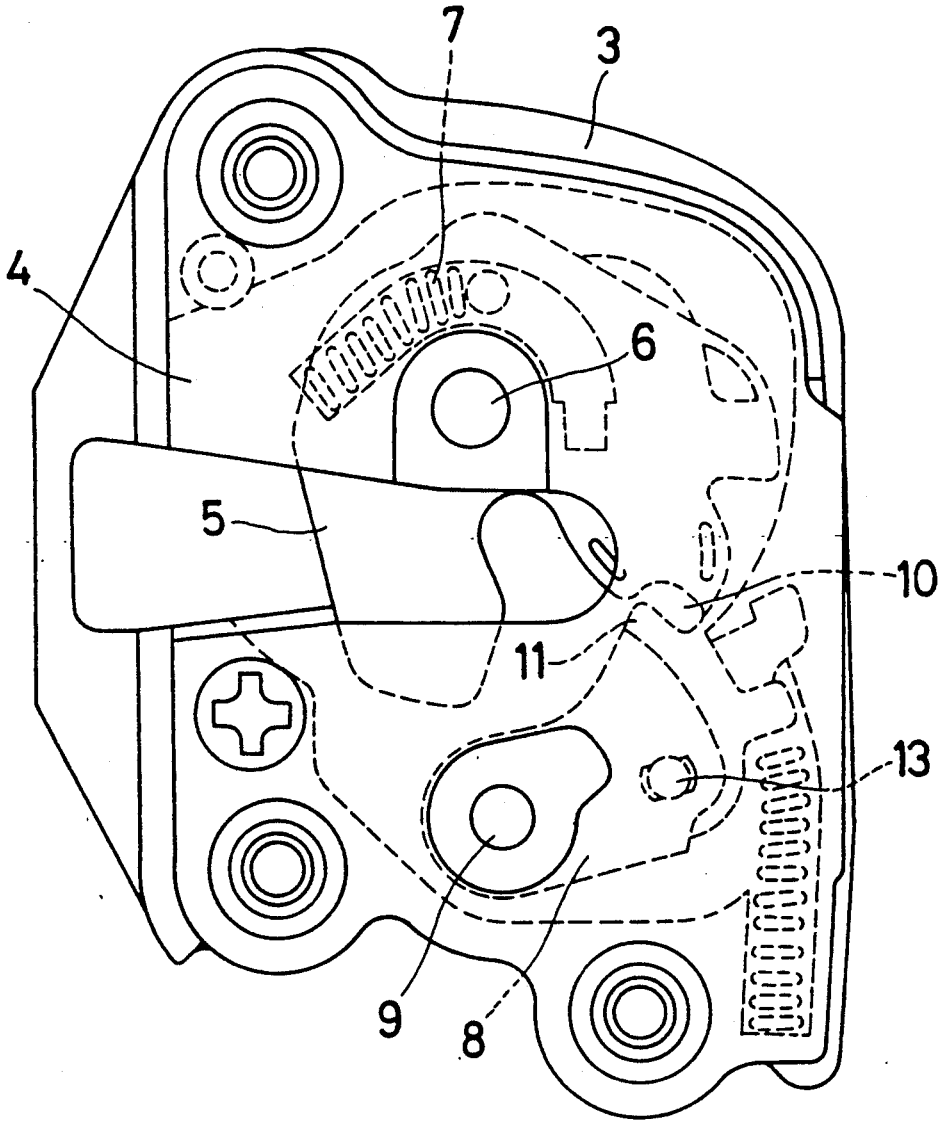
FIG. 2 is a schematic plan view of the release lever and pawl in meshing relationship.

In a cavity formed between body 3 and base 4 latch 5 is fitted on the latch pin 6 and rotates around it as an axle, and a clockwise force as shown in FIG. 2 is applied on it through a spring of the latch. A pawl 8 is set on the pawl-pin 9 and rotates around it as an axle, and an anti-clockwise force as shown in FIG. 2 is applied to it. Their projections 10 and 11 can be arranged either to mesh or not to mesh with each other.

Figure 3:
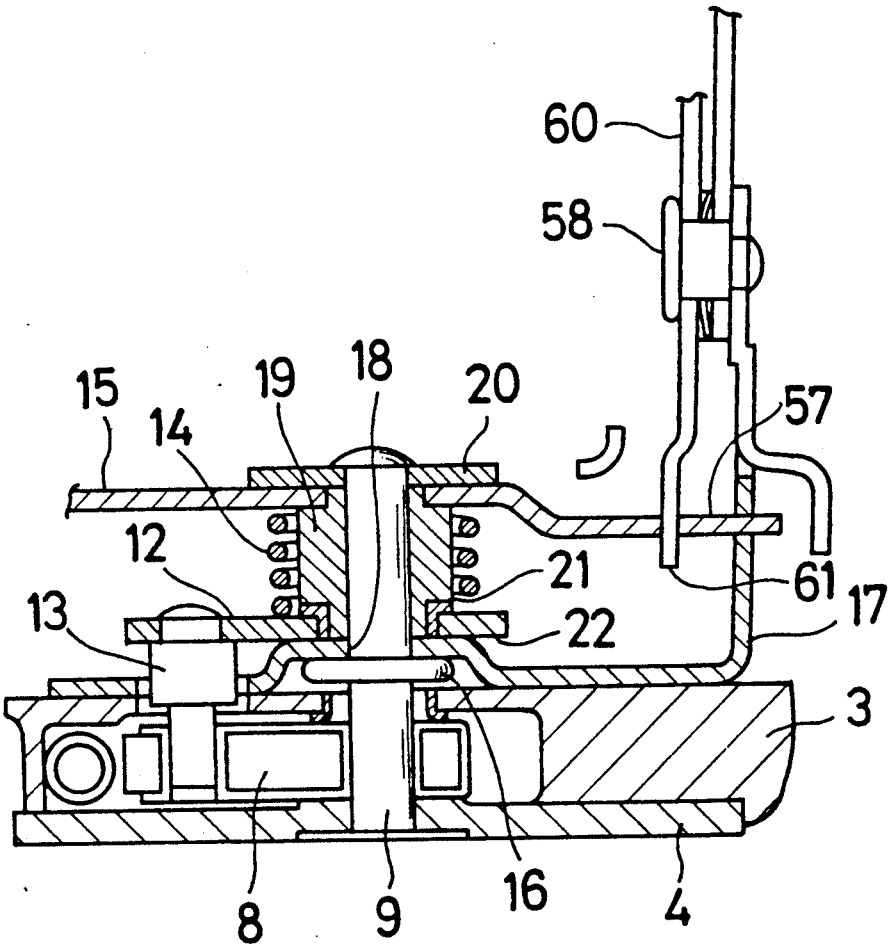
FIG. 3 is a schematic sectional view of the door lock device pole pin of FIG. 1 illustrating the pawl pin mechanism and linkage.

Pin 13 fixed on lift lever 12 can cause the pawl 8 to move simultaneously with the lift lever 12. The lift lever 12 and the pawl pin are set on the same axle as shown in FIG. 3 to relatively run and move with the outer lever 15 to which is applied a force by the spring 14.

The pawl-pin 9 has a flange 16. One end of the pin 9 passes through the rotating axle hole of the pawl 8, and the other end passes through hole 18 of sub base 17. The pawl-pin 9 is fixed on sub base 17 by lift lever 12, collar 19, outer lever 15, and washer 20.

Figure 4:
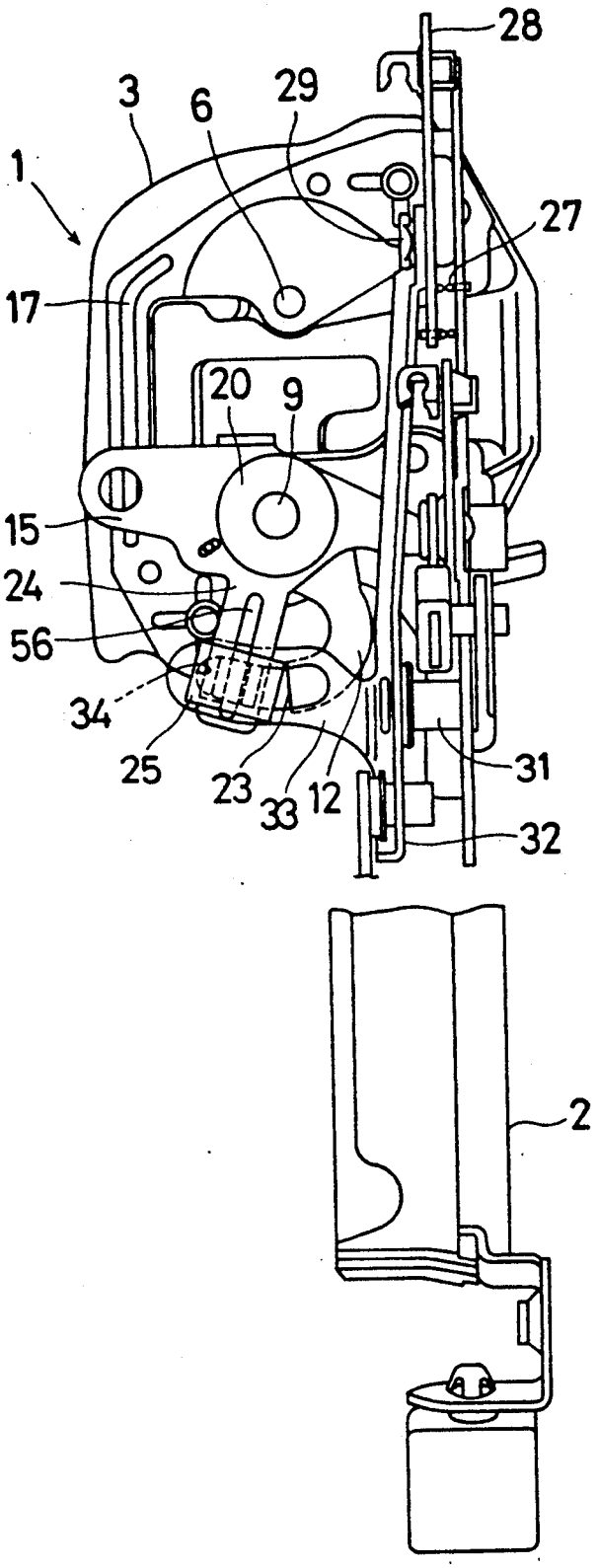
FIG. 4 is a schematic front view of the device of FIG. 1.
Figure 7:
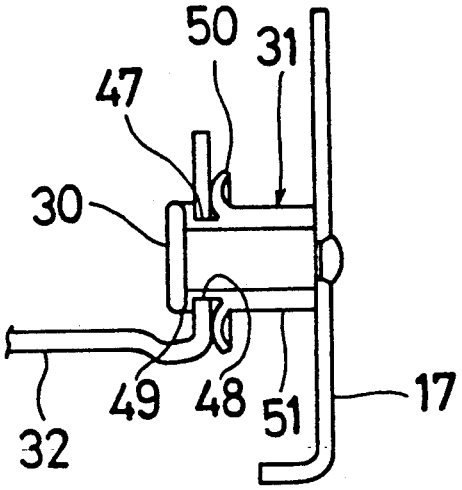
FIG. 7 is a schematic sectional view locking link and pin.
Figure 8:
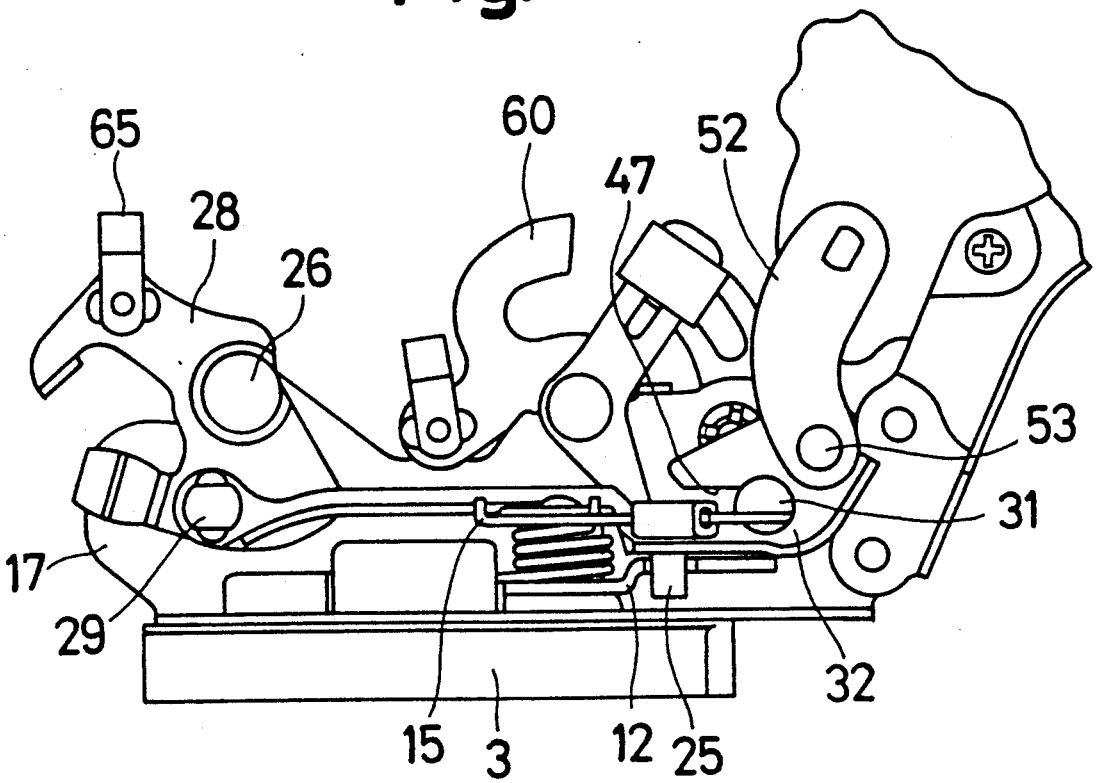
FIG. 8 is a schematic side view of the door lock device in a locked state.

Resin bush 21 and the washer 22 are fitted on the collar 19 of lift lever 12 to prevent it from contacting a metal part of the lift lever 12 when release bush 25 makes contact or breaks contact with the end surface 23 of the lift lever 12. Release bush 25 which is slidably supported on the guide part 24 of the outer lever 15 is set on a pin 26 and can turn around it. The locking lever 28, restrained by turn-back spring 27, is connected rotatably to a bush 29. A bush 31 is linked with pin 30 and fitted on the sub base 17. Keeping guide part 33 of the release bush 25, which is supported on the locking link 32 maintains a smooth state of locking or unlocking as shown in FIG. 4 and FIG. 7.

In guide part 33 of release bush 25 of the locking link 32, there is a curved groove 34 around the centre of the pawl pin 9 in the unlocked state. Release bush 25 moves with rotation of the outer lever 15.

Figure 5:
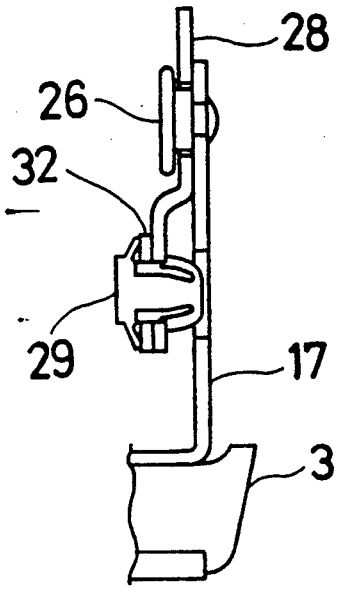
FIG. 5 is a fragmentary sectional view of the outer lever and bush.
Figure 6:
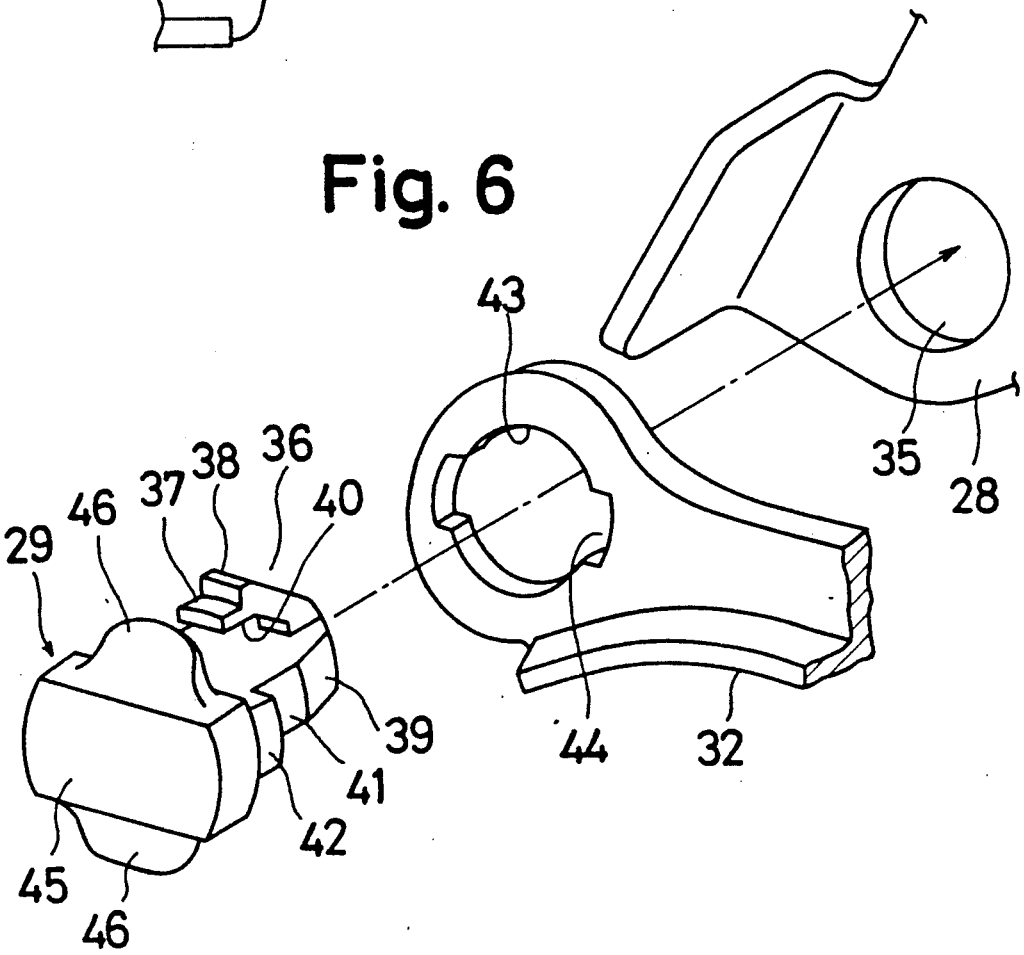
FIG. 6 is an exploded three dimensional view of the locking link and bush.

Locking lever 28 and bush 29, which is connected to locking link 32, will be described in connection with FIG. 5 and FIG. 6.

The locking lever 28 has a hole 35. The end part 36 of the bush 29 prevents bush 29 from coming out when inserted into the hole 35. On the end part 36, there is an axle neck 37, which has a diameter the same as the hole 35, and a locking edge 38, which has a diameter larger than that of axle neck 37. The locking edge 38 can be put into the hole 35 of the locking lever 28 elastically. In order to improve elasticity of the end part 36, a hole 40 is located between the locking edge 38 and a waist 39. A journal 41 fits in hole 35 of the locking lever 28 and journal 42 is supported by locking link 32 in waist 39. Because of the hole 40, the waist 39 can not be a full cylinder.

Therefore, in order to arrange the waist 39 in the direction of the delivery force of the locking lever 28 and the locking link 32, the position is determined in accordance with the locking link 32 and the axle neck 42. On the locking link 32, there is a hole 43 which has a diameter the same as the hole 35 of the locking lever 28, and a positioner 44, which has a width the same as the journal 42. The diameter of the journal 42 is larger than the journal 41. When the journal 42 is inserted into the positioner 44, the waist part 39 can be fit in the direction of the abovementioned delivering force. The numeral 45 represents the head of the component on which there are two elastic wings 46. By means of this component, the gap between locking lever 28 and locking link 32 can be prevented.

The resin bush 31 will be described in detail in connection with FIG. 7. Locking link 32 is supported slipperily on the sub base 17 by the resin bush 31.

On the resin bush 31, there is a groove 48 whose predetermined size is a little bit less than that of the groove 47 of the locking link 32, a convex part 49 whose outer diameter is larger than the groove 47, an elastic convex edge 50, which prevent the locking link 30 from lossing along the direction of the plate width with the convex part 49, and a waist part 51, which determines the position of the sub base 17. The gap between the convex edge 49 and the elastic convex edge 50 is a predetermined amount less than the thickness of the plate of locking link 32.

Additionally, locking link 32 has a groove 54 in which a pin 53 on output lever 52 of the actuator 2 is inserted.

Furthermore, a bush is set between the pin 53 and the groove 54 in order to reduce the resistance and noise during operation.

A long groove 56 on guide part 24 of the outer lever 15 is provided in order to reduce the contact surface and the operating resistance between the long groove 56 and the release bush 25 when the outer lever 15 turns to the locked or unlocked position. Furthermore, when sand and dust attach to it during the operation of the release bush 25, it becomes a groove for cleaning sand and dust, and thus the resistance caused by the sand and dust can be eliminated. Thus a stable operating resistance can be maintained for a long time. Therefore, the output of the actuator can be minimized making the actuator small and light.

End part 57 of the outer lever 15 (see FIG. 3) is fitted on the pin 58 and may rotate around it. The inside handle, (not shown) and the snap 59 are mounted closley on the end part 61 of the inner lever 60.

A component 62 is made of rubber or other elastic materials and used as a stopper of the sub base 17. The locking lever 28 is limited by stopper 63 and 64 on the above mentioned locking lever 28.

The numeral 65 represents a snap which can deliver the movement of the locking handle (not shown) to the locking lever 28.

The functions of above mechanism are explained as follows.

First to describe the (cause of) opening the door.

Figure 1:
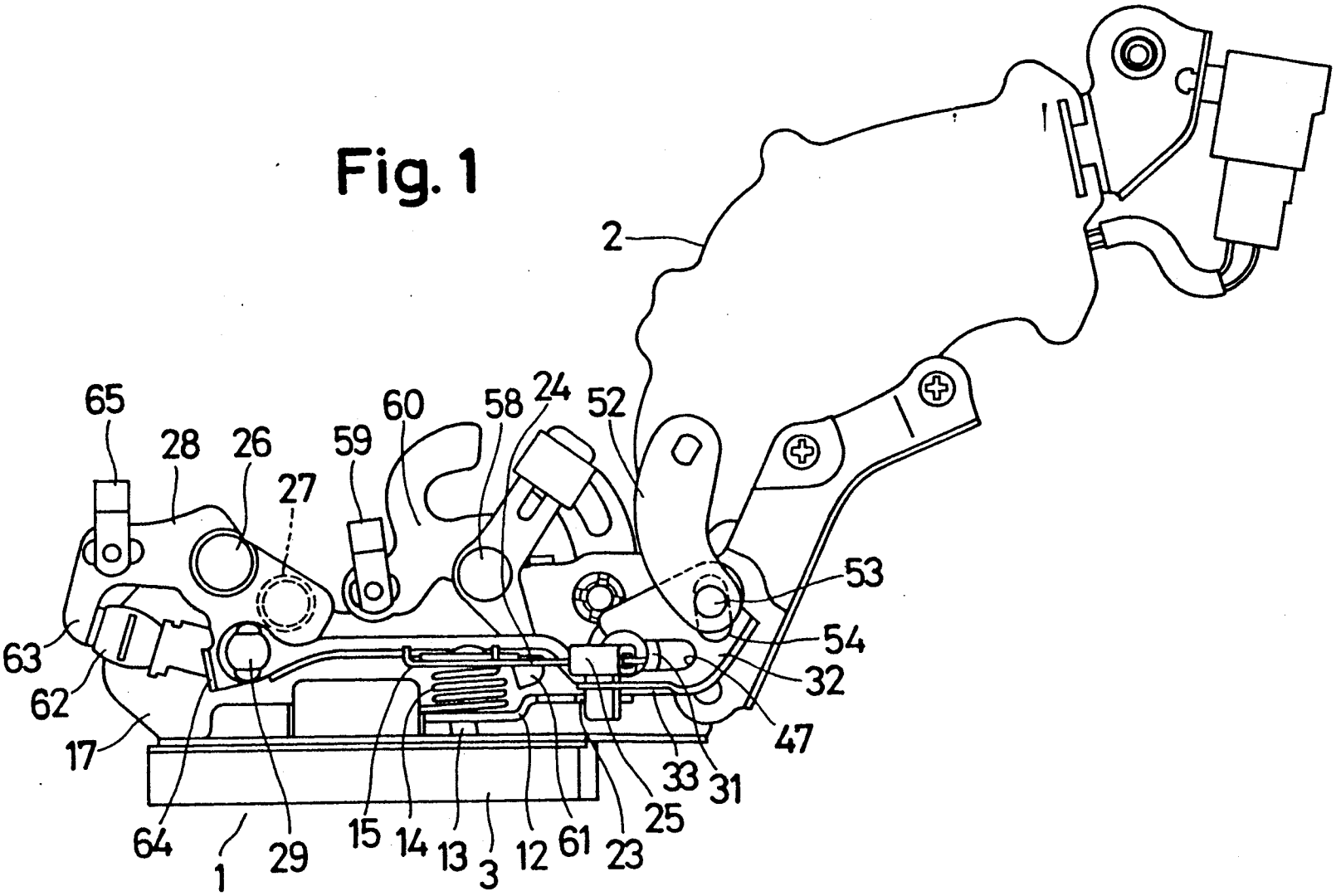
FIG. 1 is a schematic side view of a door lock device of the present invention with each kind of link in the locked state.

Starting from the locked state, the inner lever as shown in FIG. 1 is turned around the pin 58 clockwise by the inside handle (not shown); and the turning force is delivered to the end part 57 of outer lever 15 through the end part 61.

The outer lever 15 as shown in FIG. 4, turns anti-clockwise around pawl pin 9, causing lift lever 12 to turn anti-clockwise by means of close contact between end surface 23 of lift lever 12 and the release bush 25 which is supported on the guide part 24.

Thus the pawl 8 as shown in FIG. 2, connected by the lift lever 12 and its pin 13, turns clockwise around pawl pin 9, therefor the pawl 11 is separated from pawl 10 and then the latch 5 will rotate clockwise around the pawl pin through the latch spring 7. The door is opened.

Further because the release bush 25 moves in the curved groove 34 which is concentric with pawl pin 9 on the locking link 32, sliding does not take place between the interface 23 of release bush 25 and lift lever 12. The force for opening the door will be reduced. Because of no wear resin can be selected as a kind of material for making release bush 25 in any forms.

Figure 9:
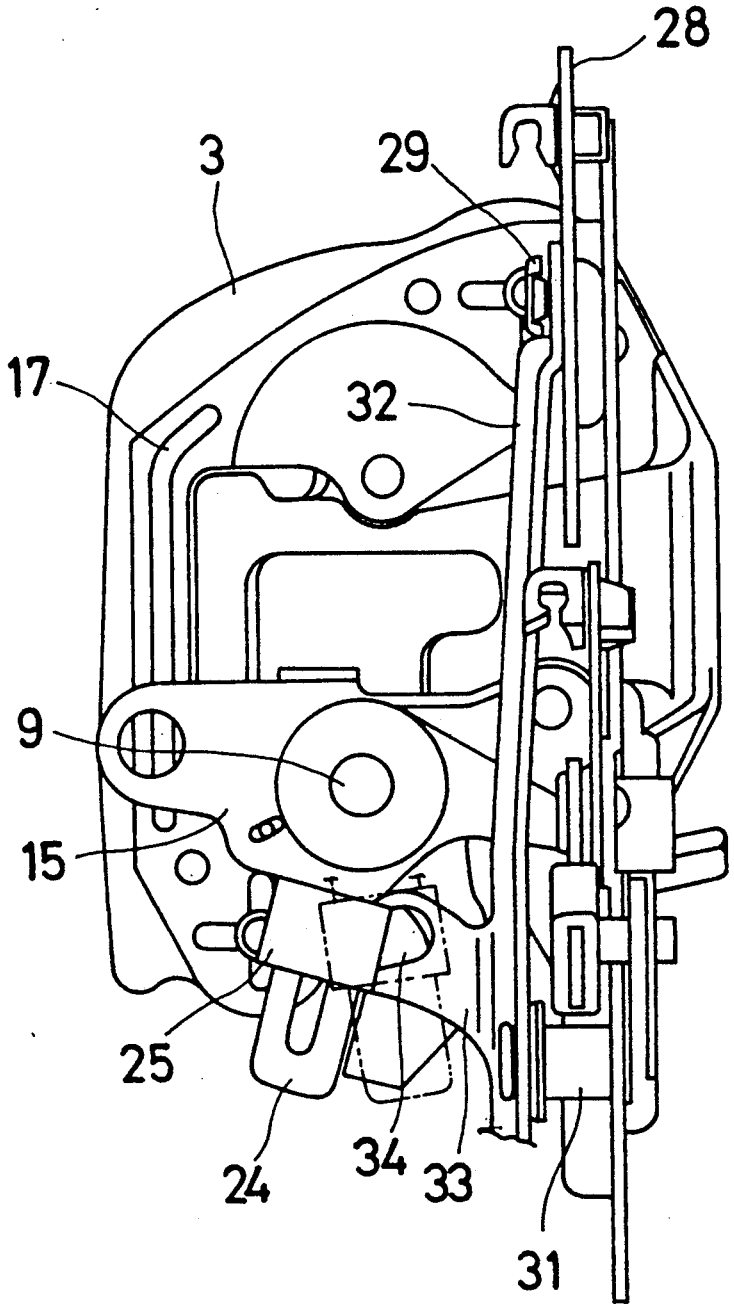

Secondly, to describe the operation from locking to unlocking. The locking handle (not shown) makes the locking lever 28 a shown in FIG. 1 turn clockwise around the pin 26. The locking link 32 connected to the bush 29 is guide along the groove 47, and is lifted upward as shown in FIG. 9. Therefore, the guide part 33 of the release bush 25 on the locking link 32 and the release bush 25 move upward along the guide part 24 of the outer lever 15. Accordingly, the release bush 25 is separated from the end part 23 of the lift lever 12. Thus the door cannot be opened even by turning the outer lever 15 or inner lever.

Further the release bush 25 can only move in the curved groove 34 of the locking link 32 and has no effect on any other component.

Furthermore, by means of the groove 54 of link 32 and pin 53, the locking link 32 while moving to the locked or unlocked position makes output lever 52 move simultaneously.

To change from the unlocked to the locked state by the actuator 2 will be described as follows.

In the unlocked state the switch (not shown) is electrically operated, the output lever 52 of the actuator 2 shown in FIG. 1 turns clockwise. Through groove 54 of the locking link 32, pin 53 which is fixed at the tip of the output lever 52 makes the link 32 lift upward as shown in FIG. 9.

The following operation is the same as the operation in which the locking handle is used.

Furthermore, a force applied to the locking link 32 through bush 29 is delivered to the locking lever 28 and makes the locking handle (not shown) move up to the locked position.

According to the present invention because there is no relative movement between the release bush and the lift lever, the operating feeling is improved. Further, because of no wear caused by sliding movement, the release bush can be made of resin in any forms to protect it against rust. Thus spring plate is easy to set in order to prevent the door from extraordinary noise during opening and closing. The quantity of the components can be reduced and its weight and production cost can be also decreased.

What is claimed is:

1. An automobile door lock device comprising:

a base having a surface area;

a sub-base spaced from the base and having an inner surface portion opposing the base surface area, the sub-base having an opening in alignment with the base surface area;

a pawl pin having a head end, a shank of substantially uniform diameter terminating at a lower end, the head end being of larger diameter than the shank, the pawl pin being inserted through the opening of the sub-base with the lower end of the shank being mounted to the surface area of the base;

a flange integrally attached to the pawl pin in engagement with the inner surface area portion of the sub-base surrounding the opening in the sub-base;

a washer disposed on the pawl pin in engagement with the head end;

a collar having an axial bore disposed on the pawl pin having first and second opposite radially extending end faces, the first end face engaging the washer and the second end face engaging the sub-base surrounding the opening of the sub-base on an outer surface portion opposite the inner surface portion; and a pawl member rotatably mounted on the pawl pin between the flange and the surface area of the base.

2. The automobile door lock device of claim 1 further comprising a lift lever rotatably mounted on the collar in engagement with the outer surface of the sub-base via an opening in the life lever.

3. The automobile door lock device of claim 2 further comprising an outer lever rotatably mounted on the collar via an opening in the outer lever and spaced from the lift lever, the lift lever being in engagement with the outer surface of the sub-base and the washer, respectively, the pawl pin being fixed to the sub-base by the lift lever, the collar, the outer lever, and the washer.

4. The automobile door lock device of claim 2 wherein the collar has a portion of reduced diameter extending to the second end face defining a shoulder surrounding the opening of the lift lever.

5. The automobile door lock device of claim 3 wherein the collar has first and second portions of reduced diameter adjacent and extending to the first and second end faces defining spaced shoulders surrounding the openings of the outer lever and lift lever, respectively.

* * * * *